US006430876B1

(12) United States Patent
Olberding et al.

(10) Patent No.: US 6,430,876 B1
(45) Date of Patent: Aug. 13, 2002

(54) DOOR HARDWARE INTERCONNECTED WITH OVERLYING REINFORCEMENT PLATE

(75) Inventors: Ronald E. Olberding, Kansas City, MO (US); David W. Allen, Overland Park, KS (US)

(73) Assignee: Edward Wayne, Inc., Overland Park, KS (US)

( * ) Notice: Subject to any disclaimer, the term of this patent is extended or adjusted under 35 U.S.C. 154(b) by 0 days.

(21) Appl. No.: 09/682,114

(22) Filed: Jul. 23, 2001

(51) Int. Cl.[7] ..... E06B 3/30
(52) U.S. Cl. ..... 49/360; 292/340; 49/361
(58) Field of Search ..... 49/460, 461, 462; 292/340, 346

(56) References Cited

U.S. PATENT DOCUMENTS 2,127,891 A * 8/1938 Starling
3,449,006 A * 6/1969 Petri
3,888,530 A * 6/1975 Fabrici ..... 292/340
4,017,106 A * 4/1977 Salazar ..... 292/340
4,057,275 A * 11/1977 La Beaud ..... 292/340
4,635,399 A * 1/1987 Gehrke et al. ..... 49/460
4,802,701 A * 2/1989 Mazie ..... 292/340
4,844,521 A * 7/1989 Langenbach et al. ..... 292/143
4,953,901 A * 9/1990 Hegdahl ..... 292/340
6,085,465 A * 7/2000 Olberding et al. ..... 49/460

* cited by examiner

*Primary Examiner*—Curtis A. Cohen
(74) *Attorney, Agent, or Firm*—Hovey Williams LLP

(57) ABSTRACT

A system for reinforcing door hardware used to associate a door with a door jamb. The door hardware includes a substantially flat body and a projection extending transversely to the body. The hardware is coupled to the jamb and the projection is at least partly overlain by a reinforcement plate attachable to the jamb.

7 Claims, 4 Drawing Sheets

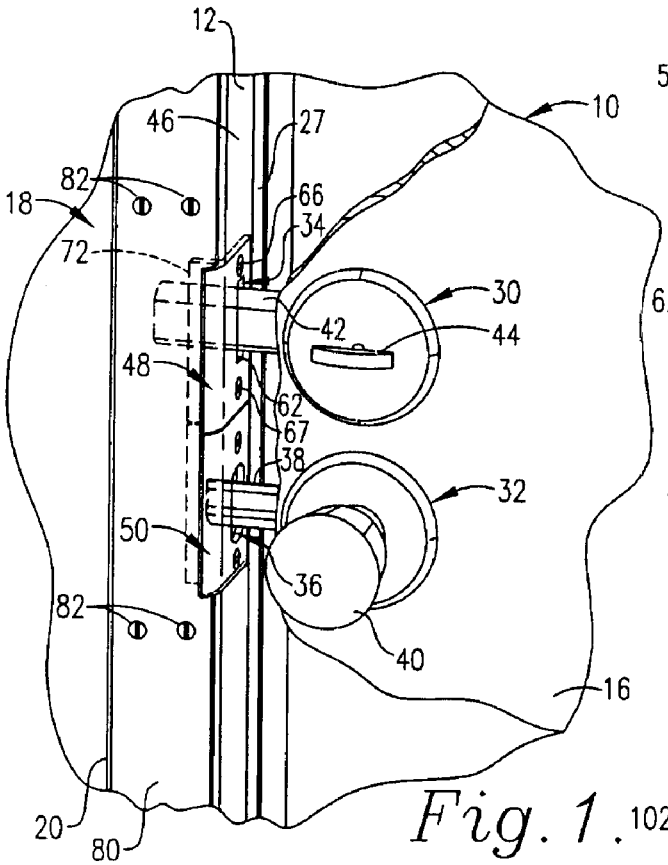
Fig. 1.
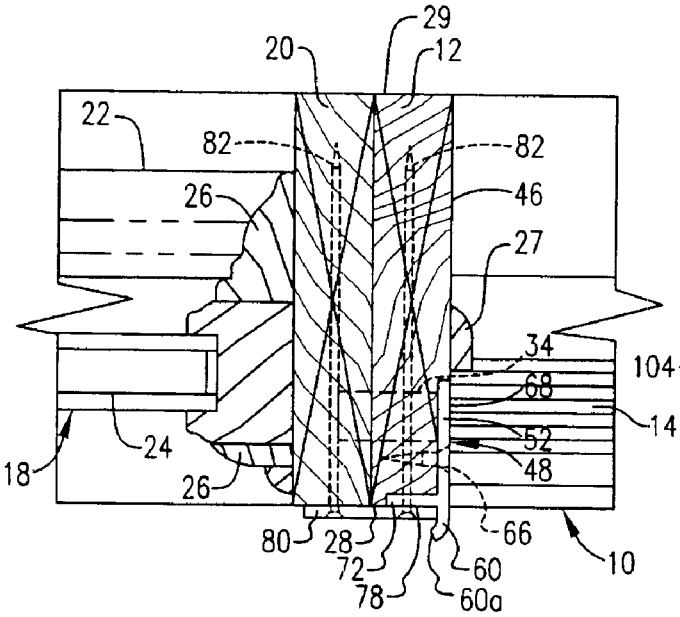
Fig. 2.
Fig. 3.
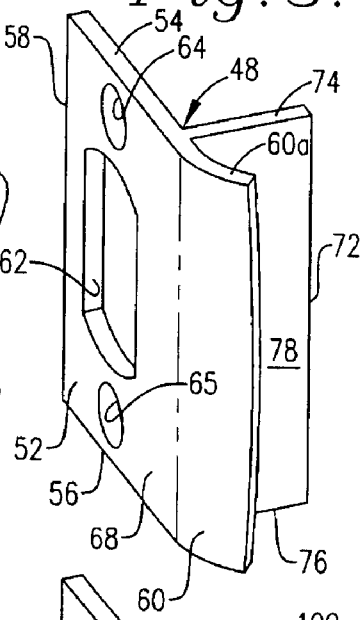
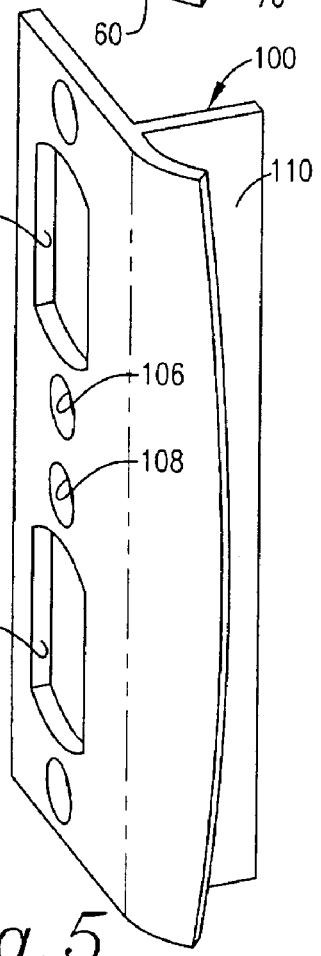
Fig. 5.

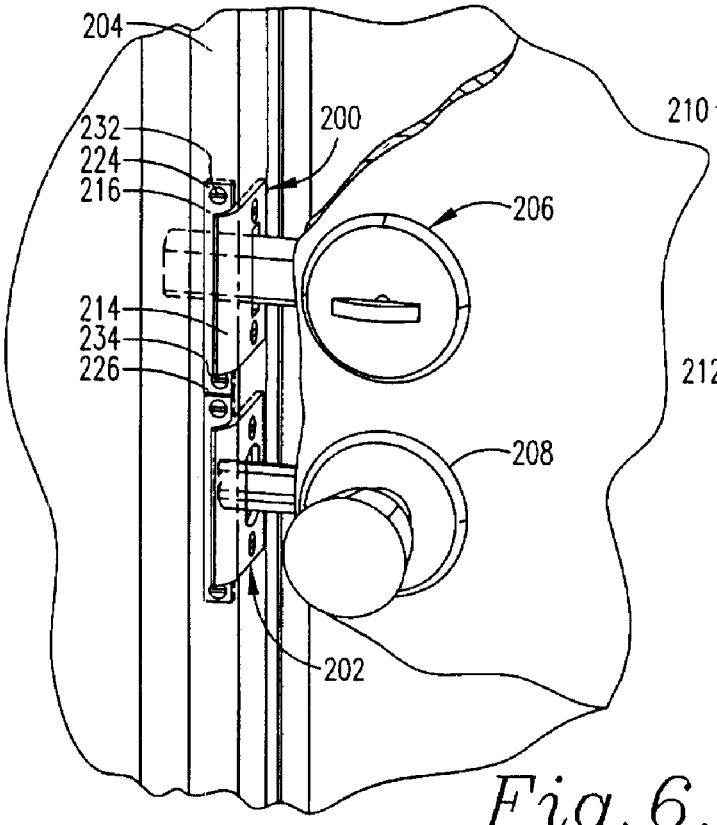
Fig. 6.
Fig. 8.
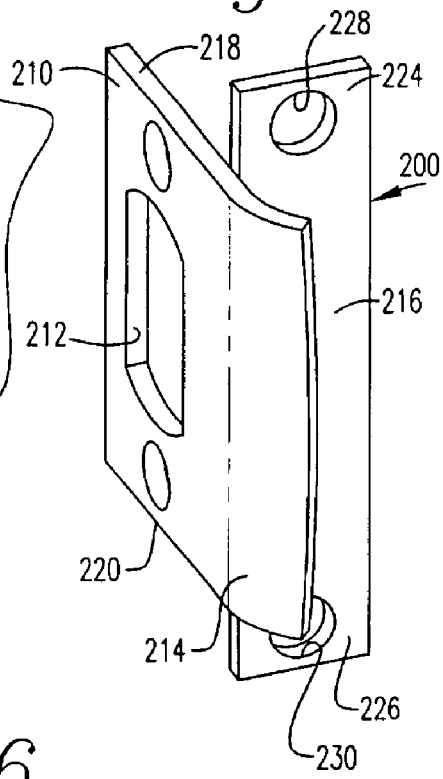
Fig. 4.
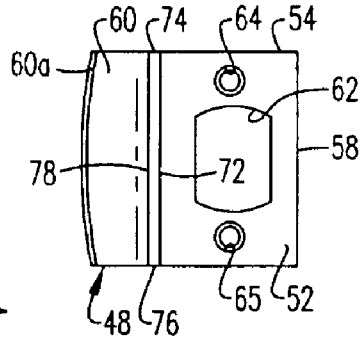
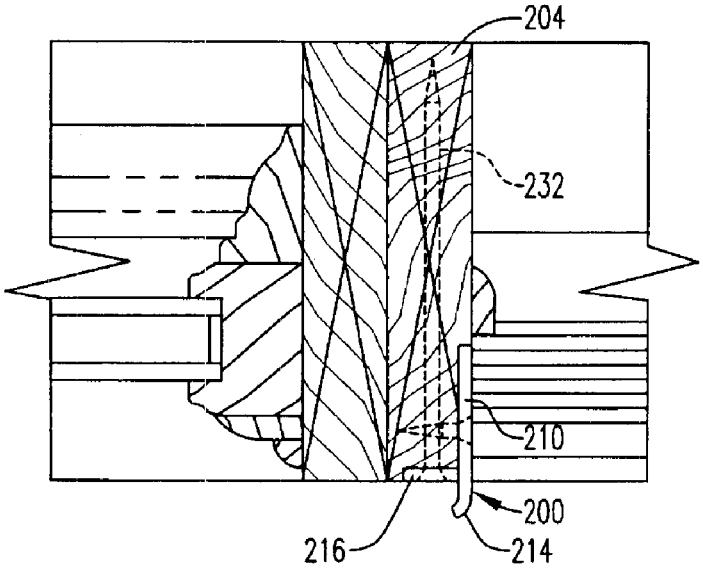
Fig. 7.
Fig. 9.
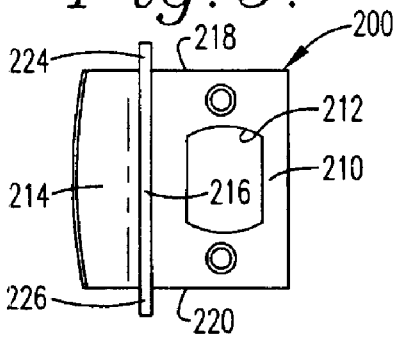

DOOR HARDWARE INTERCONNECTED WITH OVERLYING REINFORCEMENT PLATE

BACKGROUND OF INVENTION

1. Field of the Invention

The present invention relates generally to fenestration products, such as a door assembly, for installation into a house or building. More particularly, the present invention concerns an improved strike plate which reduces the risk of intrusion through the door.

2. Discussion of Prior Art

Those ordinarily skilled in the construction industry will appreciate that building security is highly dependent upon the strength of the exterior door assemblies. That is to say, intruders will often gain access to a building through an exterior door, and security of that structure may consequently be improved by reducing the risk of unauthorized access through the door. This has been previously indicated in our U.S. Pat. No. 6,085,465, issued Jul. 11, 2000, entitled DOOR REINFORCEMENT ASSEMBLY, assigned of record to the assignee of the present invention.

Our prior invention is particularly designed to address this problem by securing the door framework (e.g., one of the door jambs) to a reinforcement member fixed between the floor and the header of the structure. We have now determined that it would also be helpful to improve the locking and/or latching engagement of the door with the framework. However, to save significant time and expense, it would be highly desirable to accomplish this without sacrificing conventional door lock and latch designs.

OBJECT AND SUMMARY OF INVENTION

Responsive to these and other problems, an important object of the present invention is to provide an apparatus that reduces the risk of intrusion through a door assembly. It is also important that this object be achieved in a timely and inexpensive manner. In this respect, another important object of the present is to provide an apparatus that is designed to improve the latching and locking interengagement of a door and the corresponding framework, without requiring new latch or lock mechanism designs. That is to say, the present invention improves the latching and locking engagement provided by standard latch and lock mechanisms.

In accordance with these and other objects evident from the following description of the preferred embodiment, the present invention concerns an improved strike plate design that improves the latching and locking engagement of the door with the framework. In particular, the inventive strike plate includes a generally flat body having a bolt-receiving hole defined therein. The body is placed between the exterior and interior sides of the jamb, with the bolt-receiving hole being generally aligned with the bolt-receiving opening defined in the jamb. The strike plate further includes a substantially flat projection extending generally transversely from the body at a point spaced from the bolt-receiving hole. The projection is secured against the side of the jamb that the door moves past as it swings into and out of the closed position (i.e., the exterior or interior side of the jamb). In one embodiment, the projection is secured to the side of the jamb by a reinforcement plate attached to the side of the jamb to overlie the projection. In another embodiment, the projection includes a pair of tabs that project outwardly beyond the body, wherein each tab has a screw-receiving opening.

Although it is not entirely known as to how this strike plate design improves the locking and latching interengagement of the door and door framework, we believe that it is attributable to at least several factors. For example, the inventive strike plate is less likely to be dislodged from the jamb—a problem common to conventional strike plates when a large impact load is exerted against the exterior side of the door. Additionally, the projection itself is prevented from moving away from the corresponding side of the jamb (either by the reinforcement plate or the screws received in the tabs in the illustrated embodiments). This serves to reinforce the jamb so that the bolt cannot simply be pushed through the jamb, and to also maintain the strike plate in the desired location when an impact load is exerted against the opposite side of the door. Further, with the strike plate being securely mounted to the jamb, a large impact load exerted against the door produces a moment that is significantly less than the moment produced when the bolt engages the jamb inwardly from the plate (as is often the case with a conventional strike plate that has been dislodged from the jamb).

Other aspects and advantages of the present invention will be apparent from the following detailed description of the preferred embodiments and the accompanying drawing figures.

BRIEF DESCRIPTION OF DRAWINGS

Preferred embodiments of the invention are described in detail below with reference to the attached drawing figures, wherein:

FIG. 1 is a fragmentary perspective view of a door assembly that has been reinforced with an assembly constructed in accordance with the principles of the present invention;

FIG. 2 is an enlarged, fragmentary horizontal cross-sectional view of the door assembly shown in FIG. 1, particularly illustrating the strike plate and reinforcement plate attached to one of the jambs of the assembly;

FIG. 3 is an enlarged, perspective view of the strike plate shown in FIGS. 1–2;

FIG. 4 is an elevational view of the strike plate shown in FIGS. 1–3;

FIG. 5 is a perspective view of an alternative strike plate design, wherein the plate includes a pair of bolt-receiving holes;

FIG. 6 is a fragmentary perspective view of a third embodiment of the present invention, particularly illustrating a door assembly that has been reinforced with a strike plate constructed in accordance with the principles of the present invention;

FIG. 7 is an enlarged, fragmentary horizontal cross-sectional view of the door assembly shown in FIG. 6, particularly illustrating the strike plate being attached to one of the jambs of the assembly by a pair of long screws;

FIG. 8 is an enlarged, perspective view of the strike plate shown in FIGS. 6–7;

FIG. 9 is an elevational view of the strike plate shown in FIGS. 6–8;

DETAILED DESCRIPTION

Figure 10:
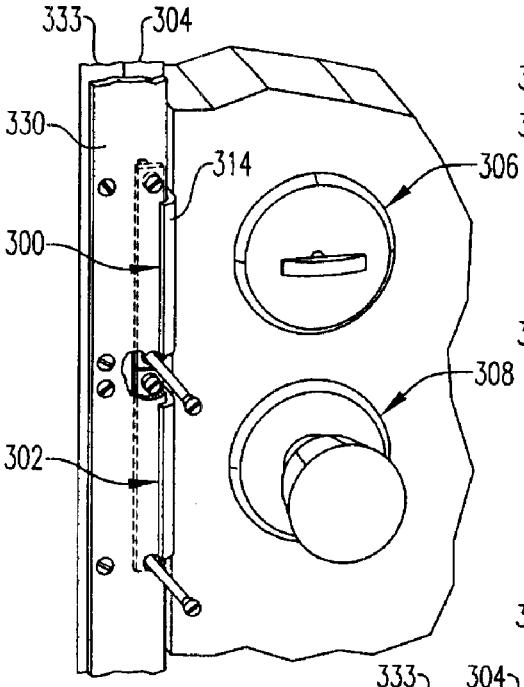
FIG. 10 is a fragmentary prospective view of another embodiment of the present invention, particularly illustrating a door assembly that has been reinforced with a strike plate overlain by and coupled to a reinforcement plate.
Figure 12:
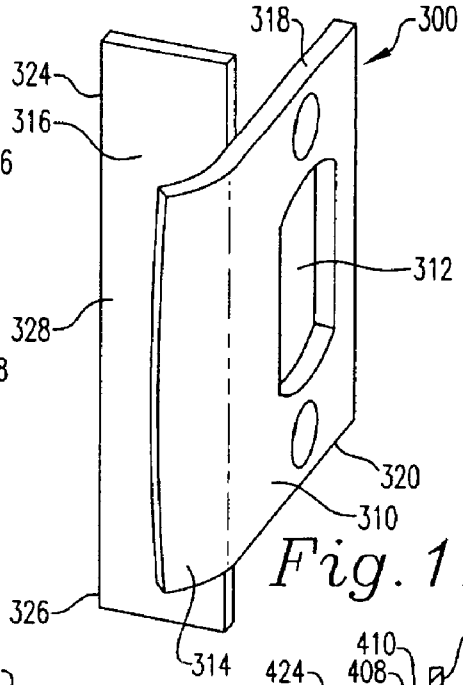
FIG. 12 is an enlarged, prospective view of the strike plate shown in FIGS. 10–11.

Turning initially to FIG. 1, the door assembly 10 selected for illustration is designed to be installed within a suitable opening (not shown) defined within a building frame (also not shown). It shall be understood that the term "building" as used herein means any structure having an interior which may be accessed through a door assembly (e.g., houses, multi-dwelling structures, commercial structures, etc.). The illustrated door assembly 10 includes an open framework comprising a pair of laterally spaced door jambs 12 (only the left jamb being shown in the drawing figures) extending between the floor (not shown) and header (not shown) of the building frame, an upper cross-beam (not shown) extending between the jambs 12 adjacent the header, and a lower sill 14 (see FIG. 2) extending between the jambs 12 adjacent the floor. A door 16 is mounted to the right jamb (not shown) for swinging movement into and out of a closed position, in which the door is received within the framework (see FIG. 1). The door 16 and the door framework are preferably formed of wood, although other suitable materials may be used.

In the illustrated embodiment, the door assembly is accompanied by a sidelight assembly 18. The sidelight assembly 18 similarly includes an open framework having a pair of laterally spaced, upright jambs 20 (only the right jamb being shown in the drawing figures) extending between the floor and header, an upper cross-beam (not shown) extending between the jambs 20 adjacent the header, and a sill 22 extending between the jambs 20 adjacent the floor. The window framework is also preferably formed of wood. The jambs 20, cross-beam and sill 22 cooperatively support a glass pane 24 therebetween. In the usual manner, the sidelight assembly 18 includes trimming 26 extending around the perimeter of the pane 24 for mounting the pane 24 in the framework and enhancing the appearance of the assembly. It will be appreciated that similar trimming may be provided around the framework of the door assembly 10. Further, additional trimming may be provided to conceal any gaps defined between the assemblies 10,18 and building frame 18 and any gaps defined between the assemblies.

If desired, a second sidelight assembly (not shown) may be provided alongside the right door jamb. However, it is entirely within the ambit of the present invention to utilize the door assembly 10 in various other types of installations. For example, the door assembly 10 need not be accompanied by a sidelight assembly, but rather it may be installed between a pair of laterally spaced cripples (not shown) of the building frame (a so-called "single door application"). Further, instead of the door and sidelight assembly having separate jambs, a single member can be used as the jamb for both the door and the sidelight assembly. This configuration is commonly referred to as a "uni-jamb".

With the foregoing caveats in mind, the door assembly 10 includes a stop 27 extending vertically along the left jamb 12 for preventing outward swinging movement of the door 16 beyond its closed position, as perhaps best shown in FIG. 2. In this respect, the door 16 is permitted to move past the interior side 28 of the door jamb 12 as it swings into and out of the closed position, but not past the exterior side 29 of the jamb. The door 16 is further maintained in the closed position by latching and locking engagement with the left door jamb 12. In particular, a standard lock mechanism 30 and standard latch mechanism 32 are mounted to the door 16, and the left door jamb is provided with a pair of bolt-receiving openings 34 and 36 for purposes which will subsequently be described.

Turning first to the latch mechanism 32, the lower bolt-receiving opening 36 is configured to receive a spring-biased bolt 38 reciprocally mounted to the door 16. In the usual manner, the bolt 38 is urged outwardly to be automatically inserted into the opening 36 when the door 16 is closed, thereby releasably retaining the door in its closed position. A rotatable interior handle 40 is coupled with the bolt 38 to shift the latter out of the opening 36, and thereby unlatch the door 16, when it is desired to swing the door 16 out of its closed position. As is custom, the outer end of the latch bolt 38 has an arcuate camming face (not shown) which cooperates with structure mounted to the left door jamb 12 to automatically shift the bolt 38 against the spring-bias as the door is swung to the closed position.

On the other hand, the lock mechanism 30 serves to lock the door 16 in its closed position. The lock mechanism 30 similarly includes a bolt 42 mounted to the door 16 for reciprocating movement into and out of the upper bolt-receiving opening 34. However, the lock bolt 42 is not spring-biased, but rather an interior hand-operated turnscrew 44 serves to control reciprocating movement of the bolt 42, along with a key-operated cylinder (not shown) mounted to the exterior side of the door. As perhaps best shown in FIG. 2, the upper bolt-receiving opening 34 extends into the adjacent window jamb 20 so that a high security lock mechanism with an extended bolt throw may be utilized. Of course, with a single door application, in which the door assembly 10 is not accompanied by a sidelight assembly, the bolt-receiving opening 34 would preferably extend into the adjacent cripple (not shown) of the building frame. In addition, if the left door jamb 12 and adjacent window jamb 20 are secured to a reinforcement member (not shown), as disclosed in our prior application, the reinforcement member is preferably provided with a slot for accommodating the lock bolt 42 when it is in the locked position.

Traditionally, a conventional strike plate (not shown) would be mounted adjacent each of the bolt-receiving openings 34 and 36. The conventional strike plate serves to prevent contact between the bolts and the finished door jamb. However, conventional strike plates provide little, if any, reinforcement to the door jamb. In addition, a conventional strike plate is typically mounted to the door jamb only by a pair of screws inserted into the exposed face (see reference numeral 46 in FIGS. 1 and 2) of the door jamb. A conventional strike plate is consequently capable of being dislodged from the door jamb even with relatively insignificant impact loads exerted against the exterior side of the door. When dislodged, the conventional strike plate is incapable of preventing movement of the bolts through the door jamb, and the jamb is consequently likely to splinter or otherwise fail adjacent the bolt-receiving openings. In some instances, when an impact load is exerted against the exterior side of a door utilized with conventional strike plates, movement of the bolts is restricted by the door jamb inside the bolt-receiving openings rather than at the exposed face of the jamb. The bolts consequently experience a relatively larger moment than an arrangement where movement of the bolts is restricted at the exposed face of the door jamb. The bolts will likely bend or otherwise fail, and thereby permit swinging of the door out of its closed position.

The present invention is particularly designed to address these problems. In particular, improved strike plates 48 and 50 are mounted to the left door jamb 12 adjacent respective ones of the bolt-receiving openings 34 and 36. The strike plates 48 and 50 are identical in construction. Thus, for the sake of brevity, only the upper strike plate 48 associated with the lock mechanism 30 will be described in detail herein, with the understanding that the lower strike plate 50 is similarly constructed.

The strike plate 48 comprises a flat body 52 that is placed along the exposed face 46 of the door jamb 12. As perhaps best shown in FIG. 4, the body 52 is generally rectangular in shape, presenting a pair of parallel, opposite ends 54 and 56 and a transverse side 58. The opposite side of the body is not exposed (and is therefore not referenced by a numeral), but rather a cam element 60 projects from the opposite side for purposes which will be described further hereinbelow. Spaced generally equally between the ends 54,56 of the body 52 is a bolt-receiving hole 62 that is configured to receive the lock bolt 42. The hole 62 is generally rectangular in shape, except for its rounded ends, although other hole shapes are within the ambit of the present invention, such as, for example, a rectangular hole with square corners. It will be appreciated that this design corresponds with the cross-sectional shape of many standard bolt constructions. A screw-receiving opening 64 and 65 (see FIGS. 3 and 4) is defined in the body 52 between the bolt-receiving hole 62 and each end 54 and 56. As shown in FIGS. 1 and 2, woodscrews 66 and 67 are inserted through the openings 64 and 65 and into the exposed face 46 of the left door jamb 12. It will be noted that the screw-receiving openings 64,65 are counterbored so as to receive the tapered heads of the screws 66,67. In addition, the body 52 is recessed within the jamb (see FIG. 2) so that the outer face 68 of the body 52 lies generally flush with the exposed face 46 of the jamb 12. This may require that a recess be cut into the jamb 12 (e.g., by use of a router) before the strike plate 48 is attached thereto.

The cam element 60 extends between the ends 54,56 of the body 52 and is generally coplanar with the body 52 except for an arcuate-shaped tip section 60*a*. It will be noted that the cam element 60 projects beyond the interior side 28 of the door jamb 12. With particular respect to the latch mechanism 32, the cam element 60 cooperates with the rounded end of the latch bolt 38 in the usual manner to shift the bolt 38 inwardly against the spring-bias as the door is swung toward the closed position. Although the cam element 60 may be eliminated on the upper strike plate 48 because the lock bolt 42 is not spring-biased outwardly, it is believed that manufacturing and installation costs are actually reduced when a universal strike plate design is used rather than different strike plates for the lock mechanism 30 and latch mechanism 32. However, it may be possible to use the inventive strike plate in conjunction with either locking mechanism 30 or latch mechanism 32.

Extending generally along the unexposed side of the body 52 is a transverse, flat projection 72 that is configured for placement along the interior side 28 of the door jamb 12. The projection has a rectangular shape and presents parallel, opposite ends 74 and 76 that are coplanar with the ends 54 and 56 of the body 52. Similar to the body 52, the projection 72 is recessed within the jamb (see FIG. 2) so that the outer face 78 of the projection 72 lies generally flush with the interior side 28 of the jamb 12. In this respect, the only portion of the strike plate 48 projecting outwardly beyond the jamb 12 is the cam element 60.

The strike plate 48 is preferably formed of an extruded metal, such as aluminum, so that the body 52, cam element 60 and projection 72 present an integral unit. In addition, the strike plate 48 is configured so that the bolt-receiving hole 62 is aligned with the bolt-receiving opening 34 when the projection 72 is secured against the jamb 12. Accordingly, this configuration may vary depending on the location of the bolt-receiving opening 34, which in turn depends upon the location of the lock mechanism 30 when the door 16 is in the closed position. With respect to the illustrated embodiment, the hole 62 is closer to the exposed side of the body 58 than the projection 72 (see FIG. 4).

In the embodiment illustrated in FIGS. 1–4, the projection 72 is prevented from disengaging the jamb 12 by a rectangular-shaped, flat reinforcement plate 80. The reinforcement plate 80 and door jamb 12 are substantially coextensive (i.e., plate 80 might be slightly shorter than the full length of the jamb 12 to permit proper alignment with the holes in the jamb), with the plate 80 extending substantially the same length as jamb 12 and overlying the door jamb 12 and a substantial portion of the window jamb 20 (see FIG. 2). In this respect, the reinforcement plate 80 also overlies the projections of each of the strike plates 48 and 50. The reinforcement plate 80 is provided with a plurality of screw-receiving holes, which are spaced in pairs along the length of the plate 80, so that long woodscrews 82 may be inserted through the plate 80 and into jambs 12,20. Because the reinforcement plate 80 is fastened against the interior sides of the jambs 12,20, the screws may have a length corresponding generally to the dimension between the interior side 28 and exterior side 29 of the left door jamb 12. Consequently, the fastening power preventing dislodgment of the strike plates 48,50 is significantly greater than that offered by a pair of screws inserted into the exposed face 46 of the door jamb 12 (as would be the case with a conventional strike plate), It will be noted that the screw-receiving openings in the reinforcement plate 80 are spaced in such a manner as to avoid interference with the projections of the strike plates 48 and 50.

The reinforcement plate 80 is preferably formed of an extruded metal, such as aluminum, although other suitable materials (e.g., fiberglass, tile, etc.) may be used. Those ordinarily skilled in the art will appreciate that the illustrated reinforcement plate 80 serves to strengthen the door framework in the same manner as the devices disclosed in our prior application. However, it is entirely within the ambit of the present invention to vary the construction of the reinforcement plate, if desired. For example, a pair of reinforcement plates may be used, one for each of the strike plates 48 and 50. In addition, the reinforcement plate 80 may be secured only to the door jamb 12 or, in the case of a single door application, to the door jamb 12 and the adjacent cripple (not shown). It is also not critical that the reinforcement plate have a solid configuration, as illustrated (e.g., the plate may be perforated, if desired). The reinforcement plate 80 can be covered with suitable trimming, as noted above, or left exposed, whichever is preferred. Alternatively, the reinforcement plate can be covered with a decorative cover plate such as, for example, the cover plate disclosed in U.S. patent application Ser. No. 09/587,863, filed Jun. 6, 2000, incorporated herein by reference. If desired, the projection 72 may be provided with screw-receiving openings (not shown) to further secure the projection to the door jamb 12. However, the openings must be located so that the long woodscrews inserted into the door jamb 12 do not interfere with the bolt-receiving openings 34 and 36.

In use, the strike plates 48 and 50 serve to significantly improve the locking and latching interengagement of the door 16 and door jamb 12. Particularly, when an intruder attempts to gain access through the door assembly 10 by exerting a large impact load against the exterior side of the door 16, the strike plates 48 and 50 are not likely to be dislodged from the door jamb 12. This is primarily attributable to the fact that the reinforcement plate 80 and, to a lesser extent, the screws 66 and 67 cooperatively prevent the projections of the plates 48 and 50 from disengaging the door jamb 12. With the projections being secured along the interior side 28 of the jamb at the same elevation as the respective bolt-receiving openings 34 and 36, the bolts 38 and 42 cannot simply be pushed through the door jamb 12. Additionally, when an impact load is exerted against the exterior side of the door 16, movement of the door 16 is restricted primarily by engagement of the bolts 38 and 42 against the respective strike plates 50 and 48. The resulting moments generated by such engagement is not likely to cause bending or failure of the bolts 38 and 42.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

For example, the present invention contemplates a single strike plate 100 having a pair of bolt-receiving holes 102 and 104 for accommodating the bolts of both the lock and latch mechanisms, as shown in FIG. 5. The strike plate 100 is otherwise very similar to the plates 48,50 shown in FIGS. 1–4, except that the strike plate 100 is elongated to extend generally the length of the two plates 48,50 combined. In addition, the strike plate 100 includes an extra pair of screw-receiving openings 106 and 108 located between the bolt-receiving holes 102 and 104. Notwithstanding these differences, the strike plate 100 is mounted to the door jamb in the same manner as the plates 48 and 50, with a reinforcement plate being attached to the interior side of the jamb to overlie the projection 110.

Another embodiment of the present invention is shown in FIGS. 6–9, wherein a pair of strike plates 200 and 202 are mounted to the door jamb 204. The strike plates 200 and 202 are identical in construction, and accordingly, only the upper strike plate 200 associated with the lock mechanism 206 will be described in detail herein, with the understanding the lower strike plate 202 associated with the latch mechanism 208 is similarly constructed. Similar to the strike plates 48 and 50 shown in FIGS. 1–4, the strike plate 200 includes a flat body 210 having a bolt-receiving hole 212 defined therein, a cam element 214 projecting from one side of the body 210, and a flat projection 216 projecting transversely from the body 210. However, the projection 216 extends outwardly beyond the ends 218 and 220 of the body 210 to present a pair of tabs 224 and 226, each of which includes a screw-receiving opening 228 and 230 (see FIGS. 8 and 9). Accordingly, the projection 216 is prevented from disengaging the door jamb 204 by long woodscrews 232 and 234 inserted through the openings 228 and 230 and into the jamb 204. Notwithstanding this distinction, the strike plates 200 and 202 operate in virtually the same manner and provide the same benefits as the previously described strike plates.

Another embodiment of the present invention is shown in FIGS. 10–13, wherein a pair of strike plates 300 and 302 are mounted to a door jamb 304. Strike plates 300 and 302 are identical in construction, and accordingly, only upper strike plate 300 associated with the lock mechanism 306 will be described in detail herein, with the understanding that lower strike plate 302 associated with latch mechanism 308 is similarly constructed. Similar to the strike plates 200 and 202 shown in FIGS. 6–9, strike plate 300 includes a flat body 310 having a bolt-receiving hole 312 defined therein, a cam element 314 projecting from one side of body 310, and a flat projection 316 projecting transversely from body 310 and extending outwardly beyond ends 318 and 320 of body 310 to present a pair of tabs 324 and 326. However, as perhaps best shown in FIG. 12, in this embodiment tabs 324 and 326 are not manufactured with screw-receiving holes therein. Rather, projection 316 is initially formed to present an outer face 328 having substantially no apertures therein.

When strike plate 300 is placed against door jamb 304 and overlain by reinforcement plate 330, the screw-receiving holes in reinforcement plate 330, can be used as a template for drilling screw receiving holes in projection 316. The post-manufacture drilling of holes in projection 316 avoids alignment problems between the screw-receiving holes in reinforcement plate 330 and the screw-receiving holes in projection 316. Such alignment problems are especially common when existing door assemblies are retrofitted with the reinforcing system of the present invention.

Figure 11:
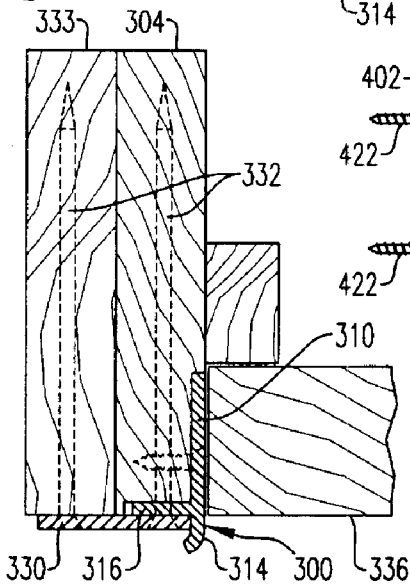
FIG. 11 is an enlarged, fragmentary horizontal cross-sectional view of the door assembly shown in FIG. 10, particularly illustrating the strike plate and reinforcement plate attached to one of the jambs via a wood screw.

As shown in FIG. 11, woodscrews 332 can be employed to fasten reinforcement plate 330 to sidelight jamb 333 and door jamb 304. On door-side jamb 304, certain woodscrews 332 will extend through aligned screw-receiving holes in both the reinforcement plate 330 and projection 316. In an alternative embodiment, shown in FIG. 13, the screws which extend through both the reinforcement plate 330 and the projection 316 can be thread-cutting screws 334. Thread-cutting screws 334 extend through reinforcement plate 330 and threadably engage projection 316. Thus, thread-cutting screws 334 fasten strike plate 300 to reinforcement plate 330, thereby more securely holding door 336 relative to door jamb 304.

Figure 14:
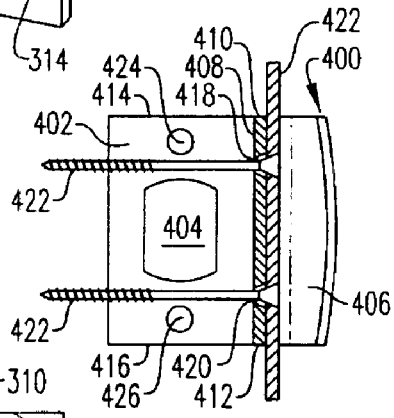
FIG. 14 is an elevational view of the strike plate shown in FIGS. 10–12.
Figure 13:
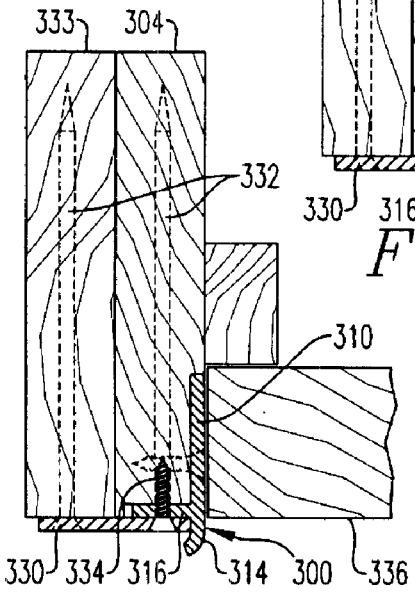
FIG. 13 is an enlarged, fragmentary horizontal cross-sectional view of the door assembly shown in FIG. 10, particularly illustrating the strike plate and reinforcement plate attached to one another by a thread cutting screw.
Figure 15:
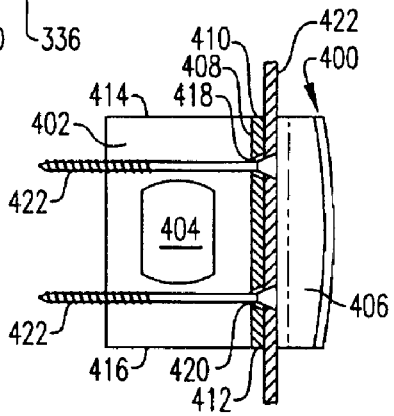
FIG. 15 is an elevational view of a strike plate similar to that shown in FIG. 14, however, the body of the strike plate does not include screw receiving holes.

Another embodiment of the present invention is shown in FIGS. 14–15, wherein a strike plate 400, similar to those described above, includes a flat body 402 having a bolt-receiving hole 404 defined therein, a cam element 406 projecting from one side of body 402, and a flat projection 408 projecting transversely from body 402. Similar to strike plates 48 and 50, shown in FIGS. 1–5, in this embodiment projection 408 presents parallel, opposite ends 410 and 412 that are coplanar with ends 414 and 416 of body 402. In other words, projection 408 does not have tabs which extend beyond ends 414 and 416 of body 402. However, in this embodiment projection 408 includes screw-receiving openings 418 and 420 therein. Thus, screws 422 are extended through aligned openings in both the reinforcement plate 423 and projection 408 to secure strike plate 400 to the door jamb (not shown). The screw-receiving opens 418 and 420 in projection 408 can be formed during the manufacture of strike plate 400 or can, alternatively, be drilled during assembly of the inventive system using the reinforcement plate 423 as a template.

As shown in FIG. 14, body 402 of strike plate 400 can include a screw openings 424 and 426 for further fastening strike plate 400 to the door jamb. Because screws extending through screw openings 424 and 426 and screw-receiving openings 418 and 420 may intersect one another it is preferred that screw openings 424 and 426 and screw-receiving openings 418 and 420 be vertically spaced from one another. Alternatively, as best illustrated in FIG. 15, body 402 of strike plate 400 can be manufacture without screw-receiving openings therein. In such a configuration, screws 422 extending through reinforcement plate 423 and projection 408 are the primary means of securing reinforcement plate 400 to the door jamb.

Figure 16:
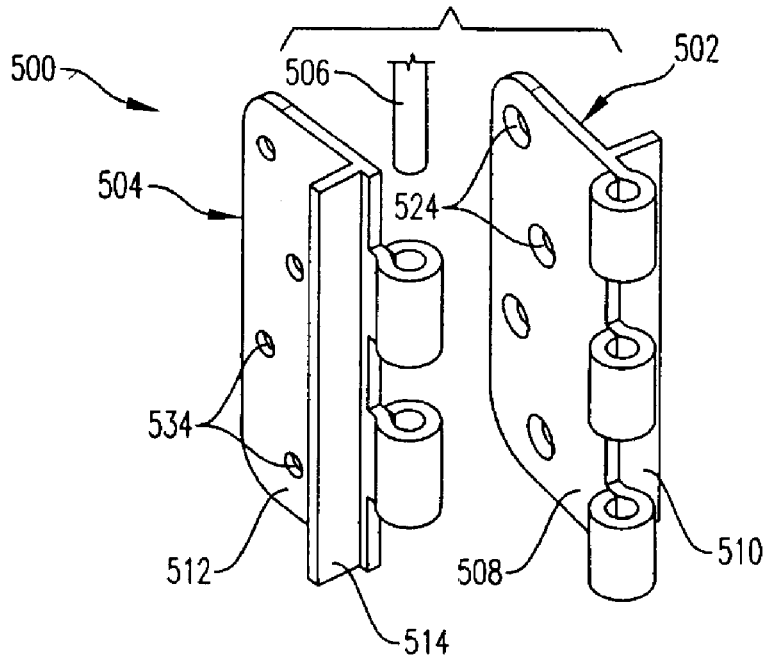
FIG. 16 is an enlarged, perspective view of a door hinge assembly according to another embodiment of the present invention.
Figure 17:
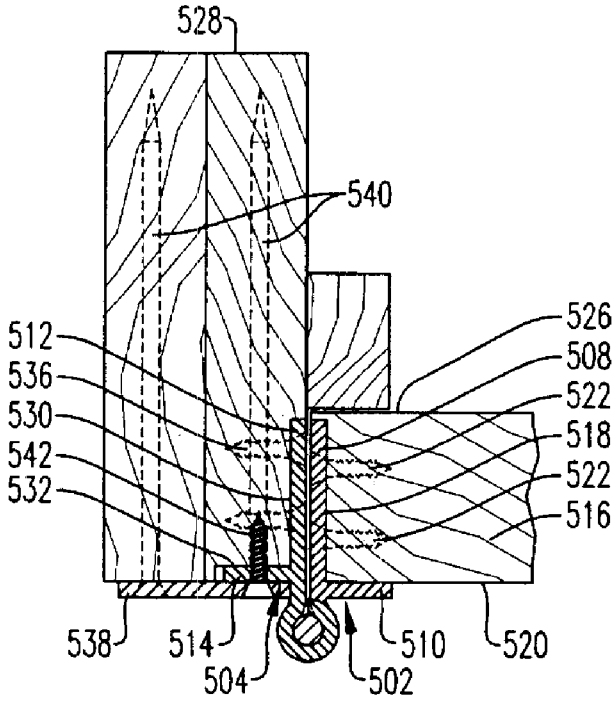
FIG. 17 is a horizontal, cross-sectional view of the hinge assembly shown in FIG. 16 coupling a door to a jamb and at least partly overlain by and attached to a reinforcement plate.

As shown in FIGS. 16–17, the inventive reinforcement system of the present invention can be implemented for use with door hardware other than strike plates. FIG. 16 shows a door hinge assembly 500 comprising a door-side hinge member 502 and a jam-side hinge member 504 adapted to be pivotally coupled to one another by a hinge pin 506. Door-side hinge member 502 includes a substantially flat body 508 and a projection 510 extending generally transverse from body 508. Jam-side hinge member 504 includes a substantially flat body 512 and a projection 514 extending generally transverse from body 512.

Referring now to FIG. 17, door-side hinge member 502 is preferably positioned on a door 516 so that substantially flat body 508 is received flushly against an edge 518 of door 516 and projection 510 is received flushly against an inside surface 520 of door 516. Door-side hinge member 502 is preferably coupled to door 516 via a plurality of wood screws 522 which extend through door-side holes 524 in body 508 and threadably engage door 516. In this configuration, projection 510 of door-side hinge member 502 inhibits separation of hinge member 502 and door 516 when an inward normal force is applied to an outside surface 526 of door 516.

Jam-side hinge member 504 is preferably positioned on hinge-side jam 528 so that flat body 512 is received flushly against an exposed face 530 of jam 528 and projection 514 is received flushly against an inside surface 532 of jam 528. Jamb-side hinge member 504 can be attached to jam 528 in the same manner described above with reference to attaching a strike plate to a door jam. Preferably, substantially flat body 512 includes a plurality of jam-side holes 534 through which wood screws 536 can be extended for engagement with jam 528. Further, a reinforcement plate 538 overlays projection 514 and is coupled to jam 528 via wood screws 540. At least one additional screw 542 extends through both reinforcement plate 538 and projection 514. Screw 542 can be a wood screw (now shown) which extends through both reinforcement plate 538 and projection 514 and threadably engages jam 528. Most preferably, screw 542 is a thread-cutting screw (as shown in FIG. 17) which extends through reinforcement plate 538 and threadably engages projection 514 to thereby fasten reinforcement plate 538 and jam-side hinge member 504 to one another.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A door assembly comprising:

a pair of spaced first and second jambs;

a door mounted on the first jamb for swinging movement into and out of a closed position in which the door is located generally between the jambs, said second jamb presenting opposite interior and exterior sides and including a bolt-receiving opening spaced between the sides, with the door moving past one of the sides as the door swings out of the closed position;

a bolt shiftably mounted to the door and being receivable within the bolt-receiving opening of the second jamb when the door is in the closed position;

a strike plate mounted to the second jamb, said strike plate including a substantially flat body extending between the sides of the second jamb and having a bolt-receiving hole that is substantially aligned with the bolt-receiving opening defined in the second jamb, said strike plate further including a substantially flat projection spaced from the bolt-receiving hole, said strike plate further including a cam element that is spaced from the projection and projects from the body beyond said one of the sides of the second jamb, said body including a flat section that extends between the bolt-receiving hole and the cam element, said projection extending generally transversely from the flat section and alongside said one of the sides of the second jamb, said body, projection, and cam element being integrally formed of extruded metal, wherein said cam element has at least a portion thereof that is generally arcuate in shape; and a substantially flat reinforcement plate attached to said one of the sides of the second jamb to overlie the projection, said reinforcement plate being fastened to the strike plate.

2. A door assembly as claimed in claim 1; and at least one screw extending through the reinforcement plate and the strike plate and threadably engaging the second jamb, said at least one screw not threadably engaging the reinforcement plate or the strike plate.

3. A door assembly as claimed in claim 1; and at least one screw extending through the reinforcement plate and threadably engaging the strike plate.

4. A door assembly as claimed in claim 3, said body presenting substantially parallel sides that are generally aligned with the sides of the second jamb, with said bolt-receiving opening being spaced between the sides of the body, said cam element projecting from one of the sides of the body, said projection extending from the body adjacent said one of the sides of the body.

5. A door assembly as claimed in claim 4, said body being recessed in the second jamb.

6. A door assembly as claimed in claim 5, said reinforcement plate and said second jamb being substantially coextensive.

7. A door assembly as claimed in claim 6, said projection being recessed in said one of the sides of the second jamb so that the reinforcement plate sets flatly against said one of the sides of the second jamb.

* * * * *